US005871105A

United States Patent [19]

Whitehead et al.

[11] Patent Number: 5,871,105

[45] Date of Patent: Feb. 16, 1999

[54] STORAGE APPARATUS FOR SPORTING GOODS

[75] Inventors: Stephen P. Whitehead, Elgin; Torrence Anderson, Naperville, both of Ill.

[73] Assignee: Suncast Corporation, Batavia, Ill.

[21] Appl. No.: 611,039

[22] Filed: Mar. 5, 1996

[51] Int. Cl.[6] ..... A47F 7/00

[52] U.S. Cl. ..... 211/14

[58] Field of Search ..... 211/14, 35, 87, 211/60.1, 13; 248/215, 304, 340

[56] References Cited

U.S. PATENT DOCUMENTS

| | | | |
|---|---|---|---|
| D. 191,790 | 11/1961 | Schaefer | D34/5 |
| D. 198,349 | 6/1964 | Saunders | D80/10 |
| D. 203,513 | 1/1966 | Warren | D34/5 |
| D. 237,231 | 10/1975 | Wells | D20/2 |
| D. 240,421 | 7/1976 | Rose | D6/4 |
| D. 261,571 | 11/1981 | Hanson | D3/38 |
| D. 283,472 | 4/1986 | Wattles | D6/463 |
| D. 283,568 | 4/1986 | Valley | D6/429 |
| D. 290,201 | 6/1987 | Wilder | D6/464 |
| D. 303,600 | 9/1989 | Thompson et al. | D6/552 |
| D. 309,226 | 7/1990 | Wilcox | D6/552 |
| D. 309,998 | 8/1990 | Sumrell et al. | D6/567 |
| D. 323,591 | 2/1992 | Stravitz | D6/437 |
| D. 385,140 | 10/1997 | Whitehead et al. | D6/574 |
| D. 390,377 | 2/1998 | Whitehead et al. | D6/449 |
| D. 390,378 | 2/1998 | Whitehead et al. | D6/449 |
| D. 393,961 | 5/1998 | Whitehead et al. | D6/464 |
| 466,608 | 1/1892 | Landis . | |
| 797,614 | 8/1905 | Schipkowsky . | |
| 860,278 | 7/1907 | Botkin . | |
| 913,228 | 2/1909 | McCarthy . | |
| 929,519 | 7/1909 | True . | |
| 1,733,487 | 10/1929 | Hackley . | |
| 1,869,226 | 7/1932 | Subick | 248/215 |
| 2,060,760 | 11/1936 | Keil | 211/87 |
| 2,090,108 | 8/1937 | Cicero | 211/35 |
| 2,122,336 | 6/1938 | Berry | 211/88 |
| 2,271,784 | 2/1942 | Tritt | 248/220 |
| 2,633,998 | 4/1953 | Derman | 211/104 |
| 2,767,854 | 10/1956 | Barrett | 211/13 |
| 2,885,090 | 5/1959 | Forman et al. | 211/175 |
| 2,930,486 | 3/1960 | Hoover | 211/44 |
| 2,950,003 | 8/1960 | Simmons et al. | 206/75 |
| 2,972,417 | 2/1961 | Smith | 211/71 |
| 3,220,363 | 11/1965 | Gingher | 108/144 |
| 3,565,020 | 2/1971 | Schier | 108/152 |
| 3,650,407 | 3/1972 | Benham, Jr. | 211/14 |
| 3,669,395 | 6/1972 | Gehrke | 248/235 |

(List continued on next page.)

FOREIGN PATENT DOCUMENTS

| | | | |
|---|---|---|---|
| 501564 | 4/1954 | Canada . | |
| 1272708 | 8/1961 | France . | |
| 1273324 | 8/1961 | France . | |
| 1274556 | 9/1961 | France . | |
| 1467884 | 12/1966 | France . | |
| 2609-790 | 9/1976 | Germany | 211/35 |
| 096105 | 2/1988 | Taiwan . | |
| 15722 | 9/1909 | United Kingdom . | |
| 253810 | 6/1926 | United Kingdom . | |
| 261537 | 11/1926 | United Kingdom . | |
| 627398 | 8/1949 | United Kingdom . | |
| 2156199 | 10/1985 | United Kingdom . | |
| WO 91/05693 | 5/1991 | WIPO . | |

*Primary Examiner*—Alvin C. Chin-Shue
*Assistant Examiner*—Sarah L. Purol
*Attorney, Agent, or Firm*—Thomas W. Tolpin

[57] ABSTRACT

A storage apparatus for holding a large variety of sports paraphernalia has rod members between opposing frame members. Upper and middle shelves are formed by upper and middle rod members with some of the rod members adjustable in a horizontal plane to hold and keep various sized balls or other sporting goods away from the wall of which the frame members are secured. A lower shelf is formed from a tray having a front support rod with hooks to hold roller skates, baseball bats, etc. between the frame members. Each frame member can include an L-shaped notch and hook that can hold hockey sticks, baseball gloves, baseball hats, etc.

18 Claims, 4 Drawing Sheets

U.S. PATENT DOCUMENTS

| | | | |
|---|---|---|---|
| 3,698,563 | 10/1972 | Gordon et al. | 211/13 |
| 3,788,241 | 1/1974 | Ravreby | 108/6 |
| 3,869,137 | 3/1975 | Byrom | 280/47.19 |
| 3,888,353 | 6/1975 | Leifheit | 211/37 |
| 3,997,060 | 12/1976 | Kunin | 211/133 |
| 4,002,241 | 1/1977 | Parrilla, Sr. | 211/88 |
| 4,049,126 | 9/1977 | Halverson | 211/60.1 |
| 4,154,442 | 5/1979 | Trubody et al. | 273/29 |
| 4,162,013 | 7/1979 | Tucker | 211/43 |
| 4,178,844 | 12/1979 | Ward et al. | 99/449 |
| 4,188,890 | 2/1980 | de Villers | 108/30 |
| 4,193,495 | 3/1980 | Keeley | 206/315 |
| 4,227,710 | 10/1980 | Laub | 280/47 |
| 4,315,633 | 2/1982 | Boeddeker et al. | 280/79.3 |
| 4,376,521 | 3/1983 | Walters | 248/206 |
| 4,561,547 | 12/1985 | Estwanik, III | 211/14 |
| 4,583,647 | 4/1986 | Schinzing | 211/60.1 |
| 4,629,065 | 12/1986 | Braaten | 206/315.1 |
| 4,633,789 | 1/1987 | Kortering et al. | 108/152 |
| 4,643,317 | 2/1987 | Wilkinson et al. | 211/14 |
| 4,674,967 | 6/1987 | Oseka | 425/110 |
| 4,676,539 | 6/1987 | Potocnjak | 294/67.4 |
| 4,678,087 | 7/1987 | York | 211/70.5 |
| 4,708,310 | 11/1987 | Smith | 248/220 |
| 4,776,650 | 10/1988 | Ferenzi | 312/245 |
| 4,854,456 | 8/1989 | Lee | 211/14 |
| 4,863,082 | 9/1989 | Evans et al. | 244/42 |
| 4,871,074 | 10/1989 | Bryson et al. | 211/13 |
| 4,936,467 | 6/1990 | Bobeczko | 211/14 |
| 5,014,948 | 5/1991 | Asaro et al. | 248/215 |
| 5,188,246 | 2/1993 | Maxworthy | 211/153 |
| 5,203,462 | 4/1993 | Brooks . | |
| 5,253,837 | 10/1993 | Loux | 248/250 |
| 5,294,005 | 3/1994 | Hedges | 211/87 |
| 5,325,973 | 7/1994 | Reedy | 211/18 |
| 5,413,228 | 5/1995 | Le Clerc . | |
| 5,706,737 | 1/1998 | Whitehead et al. | 108/42 |

STORAGE APPARATUS FOR SPORTING GOODS

FIELD OF THE INVENTION

The field of the invention is related to storage shelves, and more particularly to a multi-purpose storage rack and tray apparatus having a particular application for securing basketballs, footballs, baseballs, bats, hockey sticks, roller skates, and the like sports paraphernalia.

BACKGROUND OF THE INVENTION

Storage of sporting goods presents a special problem to the homeowner. Each sporting activity requires a unique piece of equipment leaving the homeowner with the dilemma of storing the various sized equipment. For instance, basketballs, soccer balls, softballs, baseballs, tennis balls, and racketballs are all ball shaped items that have a unique size. Further, it is not uncommon for a homeowner to have all of the above goods, including odd shaped items such as hockey sticks, baseball bats, roller skates, and baseball gloves which accompany the activity. The result is an array of items which are important for a particular sport yet provide a difficult storage problem.

Storage of such sporting goods on a conventional flat shelf also presents apparent problems. One problem is the need to prevent the aforementioned ball shaped items from rolling off the shelf. Even if shelf space is modified to secure a ball shaped item, the accompanying odd shaped items present additional problems. For instance, hockey sticks and baseball bats take up an inordinate amount of shelf space. Placing the items in a corner lends no form of organization or protection for either the item or an individual who may come in contact with a loose item. In-line roller skates are yet another sporting item commonly used which may be difficult to place on shelving as they are top heavy and the rollers make them movable. Placement of the skates in a corner may secure the rolling, but adds to room clutter and provides no protection to the skates. Improper storage of such items also makes it difficult for cleaning allowing accumulation of spiders and dirt. Improperly stored items may also lead to early degradation and with some skates costing upwards of $200, proper storage is a necessity. All of these problems are compounded in a home having more than one child for each child may have their own sporting goods.

Various attempts have been made to provide a storage device capable of holding sports paraphernalia, all with limited degrees of accomplishment. For example, U.S. Pat. No. 5,203,462 discloses a sports equipment rack having a ball holder constructed from a tubular rod bent into U-shaped configurations providing support for ball shaped items wherein a rod continuance leads to an arcuate shaped leg providing a hook bracket for placement of a baseball bat in a horizontal position.

U.S. Pat. No. 5,413,228 discloses a sports storage rack having a slotted member for supporting a baseball bat and an indented member providing for positioning of a baseball.

U.S. Pat. No. 4,936,467 discloses a sports equipment rack which consists of two frame members spaced apart by telescoping members. The rod members allow items to be placed against the wall with hooks on the front of each frame to allow storage of gloves and caps. Brackets bolted to the side of the frame provide storage for baseball bats. A disadvantage to this device is the use of the wall as a partial support which results in soiling of the wall. For instance, a basketball placed on the device is likely to impart marks on the adjoining wall leading to an unsightly arrangement. Should the basketball be wet it may not only soil the wall, but cause warpage of the wall. In addition, the device fails to provide a means for holding small items, as well as non-conforming items which may accompany a sporting activity, such as street hockey which employs hockey sticks, in-line skates and a hockey ball. Nondescript items also can not be stored, such as frisbees and paddle rackets.

Thus, what is lacking in the art is a multi-purpose sports rack capable of supporting sports paraphernalia that encompass a wide range of sports, including miscellaneous odd shaped sporting items.

BRIEF SUMMARY OF THE INVENTION

The instant invention is a rack, tray, and storage apparatus capable of holding a variety of sports paraphernalia in an orderly manner with provisions to eliminate the reliance on the supporting wall. The instant invention comprises of two spaced apart frame members that are coupled together by coated rod members and secured to a wall. Placement of the rod members provides three levels of shelving. An upper level comprises two rod members on a horizontal plane for storage of larger ball shaped items such as beachballs, footballs, basketballs, soccer balls, and the like. A rod support provision allows a rear rod member to be moved thereby storing smaller sized sports items if needed. The rods are positioned to prevent the balls from contacting the wall.

A middle level comprises of rod members also placed on a horizontal plane providing storage of smaller items such as baseballs and softballs. A rod support provision also allows the rods to be moved into a closer proximity for customized storage applications.

A lower level storage area is provided by a tray which supports odd shaped items that do not store easily on the rod shelves. The tray has a front and rear wall with the frame members providing side walls.

Each frame member further includes an arcuate L-shaped notch used for support of items in a horizontal plane. The notch includes an upwardly extending protrusion which may operate as a hook for placement of baseball gloves, baseball hats, coats, and so forth. As each member forms a mirror shape, the notch operates as a holding area for hockey sticks as the L-shape assimilates the shape of a hockey stick handle. Each frame member further includes an ornamental side wall design to enhance the appearance of the rack.

So as to expand the versatility of the instant invention, each rod member is capable of supporting individual racks for storing baseball bats, in-line roller skates, and so forth. For instance, a baseball bat hook comprises of a U-shaped member sized to engage the end of a baseball bat. A second holder is provided for support of in-line roller skates allowing placement of the skates in an upright position by use of an inverted T-shaped support post. Thus, each hook allows the rack to be more versatile as the rack shelving may hold various ancillary items without interference. In this manner, the rack and tray device may hold all the components of a street hockey game.

In light of the above, an objective of the instant invention is to disclose a storage apparatus capable of holding a wide variety of sporting goods.

Yet another objective of the instant invention is to disclose a storage apparatus that can be modified for a particular circumstance by the inclusion of mounting hooks for baseball bats, in-line skates, and the like sporting goods.

Still another objective of the instant invention is to disclose a storage apparatus that is mountable to a wall with provisions for maintaining items stored thereon, away from the wall, thereby preventing soiling of the wall.

Still yet another objective of the instant invention is to disclose a lightweight non-corrodible storage apparatus having shelf members that are adjustable in their spacial relationship allowing the shelf customization.

Yet another objective of the instant invention is to disclose a storage apparatus having functional frame members including an ornamental design for enhancing the aesthetic appeal of the apparatus.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENT

Figure 1:
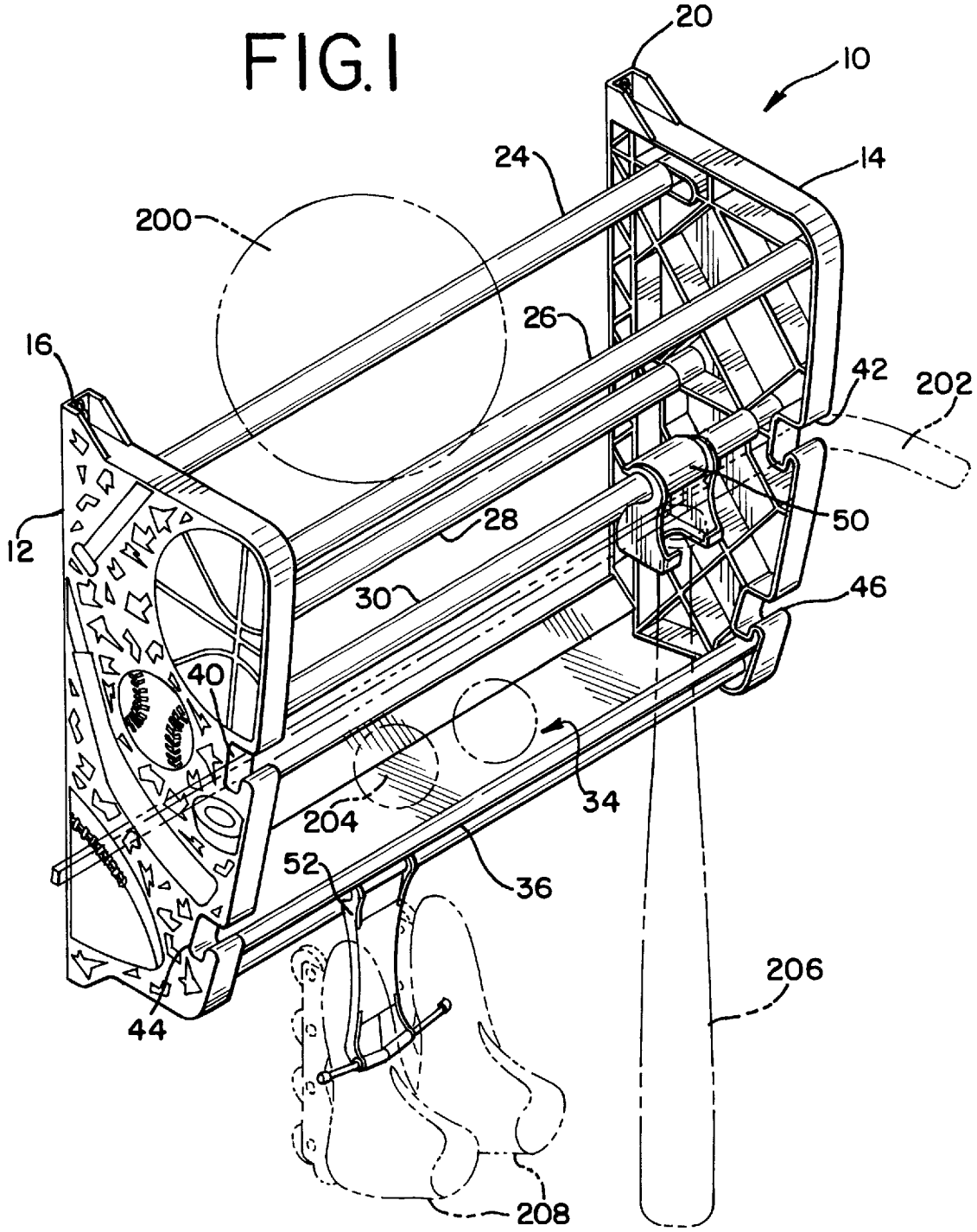
FIG. 1 is a perspective view of a storage apparatus for sporting goods in accordance with principles of the instant invention having a hidden line pictorial of various sports paraphernalia placed thereon.

Referring to the various Figures and in particular FIG. 1, set forth is the storage apparatus for sporting goods of the instant invention denoted by numeral 10. The storage apparatus provides a device comprising of a first frame member 12 and a second frame member 14 which forms a substantially identical configuration to the first frame member 12 The frame members are symmetrical and mirror images of each other. The frame members 12 and 14 are secured to a wall, not shown, by the use of fasteners positioned through holes 16 and 18 (FIG. 4) of frame member 12 and holes 20 and 22 of frame member 14. For ease of attachment to a wall, 16 and 20 are keyhole shaped allowing the frame members to be hooked over an imbedded fastener during installation. The frame members are spaced apart a fixed distance by a plurality of horizontally disposed tubular shaped support rod members. The distance defined by proper hockey stick support.

An upper shelf support is provided by first rod member 24 (FIG. 1) and a second rod member 26. As will be described later in this specification the first, rod member 24 is movable along a horizontal plane wherein the spacing between frame members 12 and 14 is constant and the spacing between the first and second rod members 24 and 26 are adjustable, the adjustment maintaining the rod members on a parallel horizontal plane. Similarly, a third lower rod member 28 is placed a fixed distance from a fourth rod member 30 wherein the third rod member 28 maintains similar properties to the first rod member 24 allowing an adjustment of the spacing between the third and fourth rod members to provide a range of adjustment for securing of various size sports paraphernalia. In addition, the spacing between the upper rod members and the lower rod members allows the support of larger items, such as soccer balls and basketballs, whereas the lower shelving, comprising a tray 34 is capable of supporting smaller sporting paraphernalia, such as footballs, softballs and so forth. It is noted that the placement of rod members 24 and 26 prevent soiling of the wall by preventing the sports objects from contacting the wall surface.

The rod members 24, 26, 28, and 30 are constructed of steel tubing and preferably placed within a plastic polyethylene sleeve which is heated so as to conform to the diameter of the tube. The combination provides an inexpensive rigid support member having non-corrodible tendencies and can be made of a variety of colors so as to match the color scheme of the storage device. Tray 34 provides for the securement of miscellaneous items wherein a bottom tray—supporting fifth rod member 36 (FIGS. 1 and 4) forms a frontal spacial support for the tray. As will be described later in this specification, frame members 12 and 14 include a means for positioning of the tray by use of a spacial slot along a bottom edge of each frame member providing support to each end of the tray.

The frame members 12 and 14 include indicia formed along the side surface of each frame member providing an ornamental design to the device. Notches 40 and 42 (FIG. 1) are located on frame members 12 and 14, respectively. Each notch comprises an L-shaped downwardly facing chamber which allows the placement of various items hanging from an upwardly facing protrusion, including baseball gloves, hats, coats, and so forth. The square shape is receptive to the shank of a hockey stick. Similarly, notches 44 and 46 are located along the lower edge of frame member 12 and 14 respectively further providing a dual purpose chamber, hockey stick holder as well as an hook. By use of rigid rod members, provisions are made for support of various other sporting paraphernalia, such as baseball bats, by use of hook member 50 comprising a baseball bat holder shown placed over lower front rod member 30, as well as a skate support rack 52 comprising a skate holder fourth which is shown over fifth rod member 36 which supports the front surface of tray 34.

By way of pictorial illustration, FIG. 1 depicts various sports paraphernalia such as beach ball 200 placed on the upper support shelf formed by upper first and second rod members 24 and 26. It should be apparent that a basketball, soccer ball, and the like can be substituted, and adjustment made therefore, by sliding of rear rod first member 24 in a closer relation to front second rod member 26. Hockey stick 202 is depicted secured to the device of notches 40 and 42 which span the distance of frame members 12 and 14. As previously mentioned, frame members 12 and 14 are spaced apart a fixed distance allowing for the proper support of such a hockey stick 202 without requirement of frame member adjustment. Tray 34 is shown with baseballs 204 depicted thereon illustrating a storage rack capable of holding non-conforming items not possible with the prior art, which further includes racketballs, tennis balls, golf balls, marbles or any other item that may be of a sports nature and cannot be held by placement between the spaced apart rod members. Baseball bat 206 is depicted in a vertical position upon insertion into the slotted aperture as the baseball bat hook 50 is positioned over rod member 30. Skates 208 are depicted in a support position engaging skate support rack 52 which is hooked over rod member 36.

Figure 2:
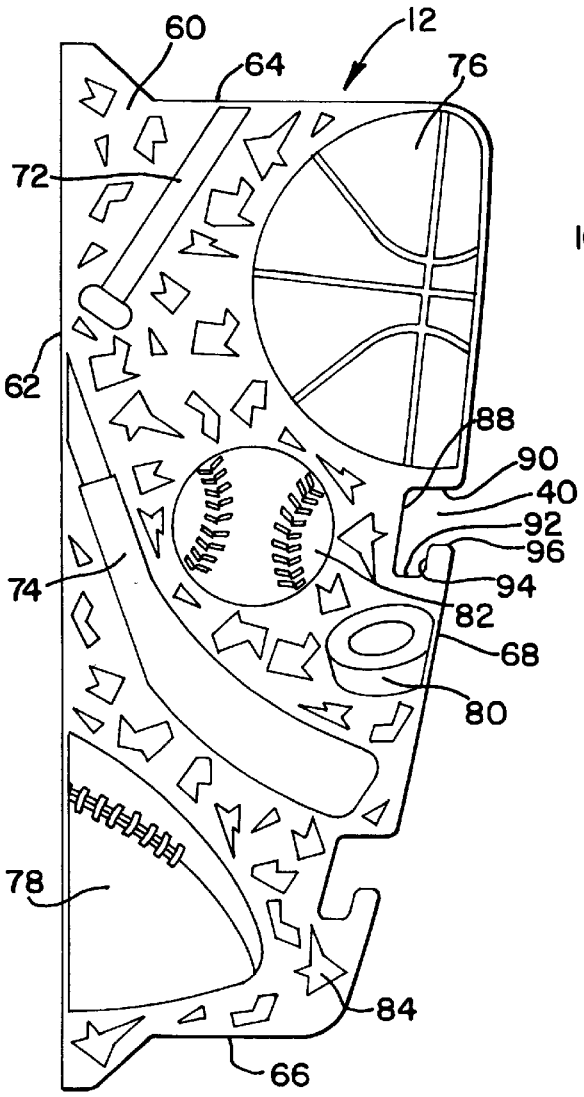
FIG. 2 is a left side view of a frame member of the storage apparatus.
Figure 3:
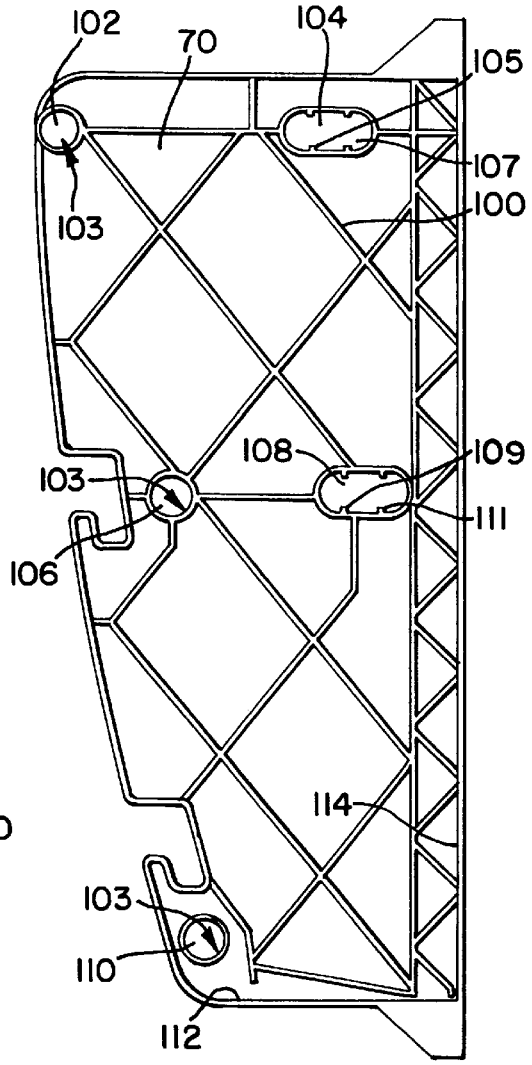
FIG. 3 is a right side view of the frame member FIG. 2.

Frame member 12, illustrated in FIGS. 2 and 3, is constructed from a single piece of molded plastic having an outer wall 60, rear edge 62, upper edge 64, bottom edge 66, front edge 68 and an inner side wall 70. The outer side wall 60 includes molded raised indicia and in this embodiment depicts the end of a baseball bat 72, the tip of a hockey stick 74, a portion of a basketball 76, a portion of a football 78, a portion of a hockey puck 80, and the shape of a baseball 82. Nondescript raised graphic indicia 84 is placed throughout the surface structure providing for an overall ornamental design.

Notch support 40 is further defined as having a back wall 88 which is joined by an upper wall 90, lower wall 92 and inner facing wall 94. The inner facing wall leads up to protruding member 96 which provides a dual purpose protrusion and it is noted that the front surface 68 is continuous so as not to cause an outward extending shape considered a safety hazard when dealing with adolescents. The notch 40 operates as a cavity wherein the back wall 88, lower wall 92, and inner facing wall 94 operate in conjunction to secure the handle of a hockey stick in a fixed position. As previously described, the tip of the notch 40 as enumerated by 96 further provides a provision for placement of baseball gloves, hats, helmets, or any other device that has a strap that could be placed over the upward protruding member 96.

Figure 3A:
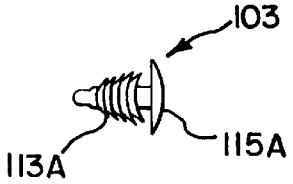
FIG. 3A s an enlarged view of an insertion screw.

As shown in FIG. 3, the inside surface 70 of the frame member includes raised ridges 100 to provide structural support through the frame member and include a fixed aperture 102 for fixed stationary placement of the front rod member and an elongated, slotted aperture 104 providing a slot for slidable placement and horizontal movement and adjustment of a rear rod member. The fixed aperture includes a means for securing a rod therein by use of a fastener comprising a plastic insertion screw 103 which operates in conjunction with a through hole located in an end of the rod member to be positioned in the frame member. The insertion screw is used to couple the rod members in apertures 102, 106 and 110. The plastic insertion screw, shown in FIG. 3A, includes a body having a plurality of biased expansion rings—113A that allow for ease of insertion but inhibit removal. An oversized head—115A allows an individual to insert the screw without the need for hand tools.

The elongated, slotted aperture 104 located along the back of the frame allows a rod member to slide along a horizontal plane so as to move the proximity of the rod member placed therein in correlation with fixed aperture 102. The slotted aperture 104 includes detents 105 located along a lower edge of the slot with a corresponding detent depending from an upper edge and detents 107 also located along a lower edge of the slot with a corresponding detent depending from an upper edge of the slot. The detents provide frictional engagement to the rod member for positioning of the rod member along the front, center, or rear of the slot. The detents create the three positions providing sufficient flex to allow forcibly movement of the rod member without loss of its positioning ability.

Lower front rod member is placed within fixed aperture 106 having a corresponding rear slotted aperture 108 providing a slot which allows a placement of a rod member therein with the spatial distance between the rods adjusted by movement of the rear rod member within the slotted aperture. As with the upper apertures, insertion screw 103 secures the rod member in position while detents 109 and 111 provides for positioning of the rear rod member in slot 108. Placement of an inner and outer rod member along the same parallel plane prevents contact of any sports paraphernalia with a wall member thereby preventing the soiling of the wall.

Fixed aperture 110 is located along the lower edge of the frame member 36 (FIG. 1) and is used for holding of a tray rod member. Tray 30 providing a tray member has a front portion which hooks over and is supported by the rod member 36 inserted into fixed aperture 110 inner edge 112 and back edge of the frame members provide support for the tray as the tray extends along the edge and upwardly along back edge 114 thereby providing a tray with a front and back section which are laterally enclosed by side edges provided by opposing frame members.

Figure 4:
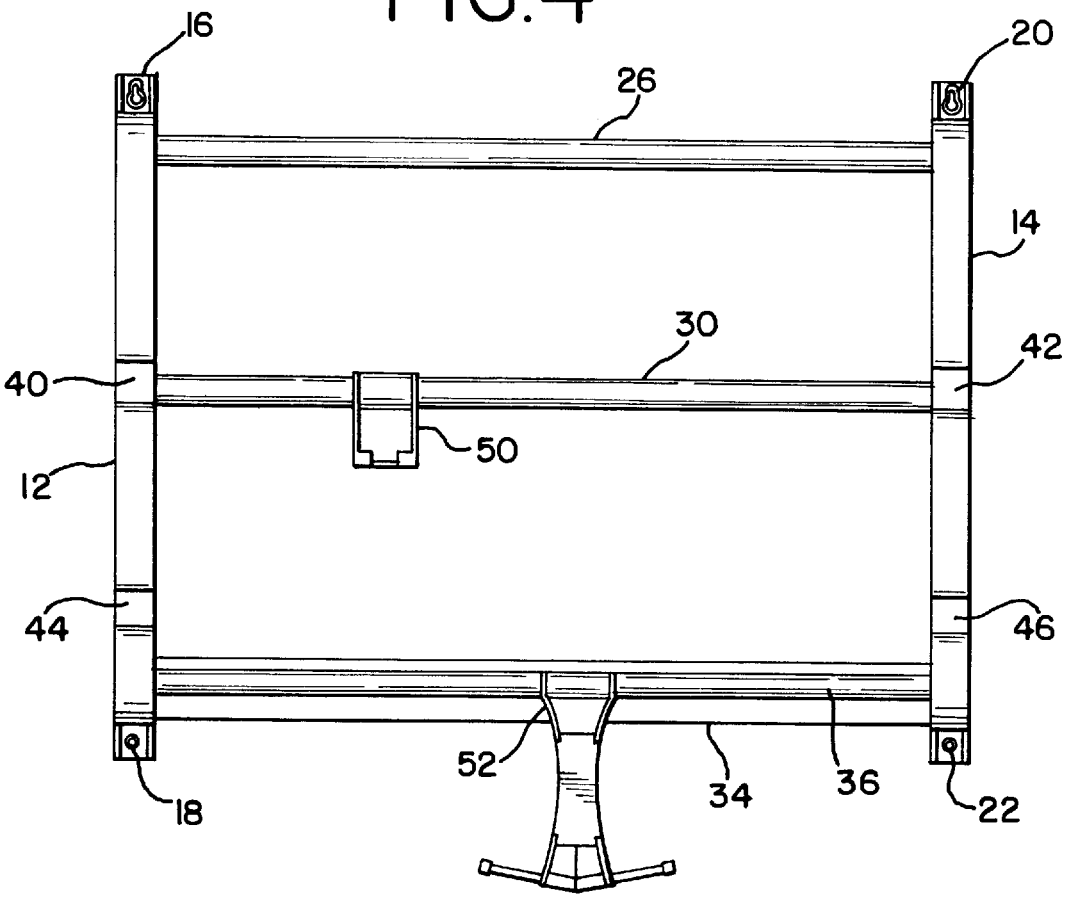
FIG. 4 is a front elevational view of the storage apparatus.

Now referring to FIG. 4, there is shown a front view of the invention with frame member 12 and 14 spaced apart with upper rod member 26, lower rod member 30, and tray 34. In this embodiment, it is noted that additional items may be supported by the storage apparatus by use of the bat holder 50 and skate support rack 52 providing a skate holder. The L-shaped notches 40 and 42 are shown on a horizontal plane for use in supporting a previously described hockey stick in a similarly manner as L-shaped notches 44 and 46. The notches do not lend to any type of protrusion thereby providing a frontal surface of each frame member with a flat curvature so as to prevent injury to a child who may accidentally bump into the device.

Figure 5:
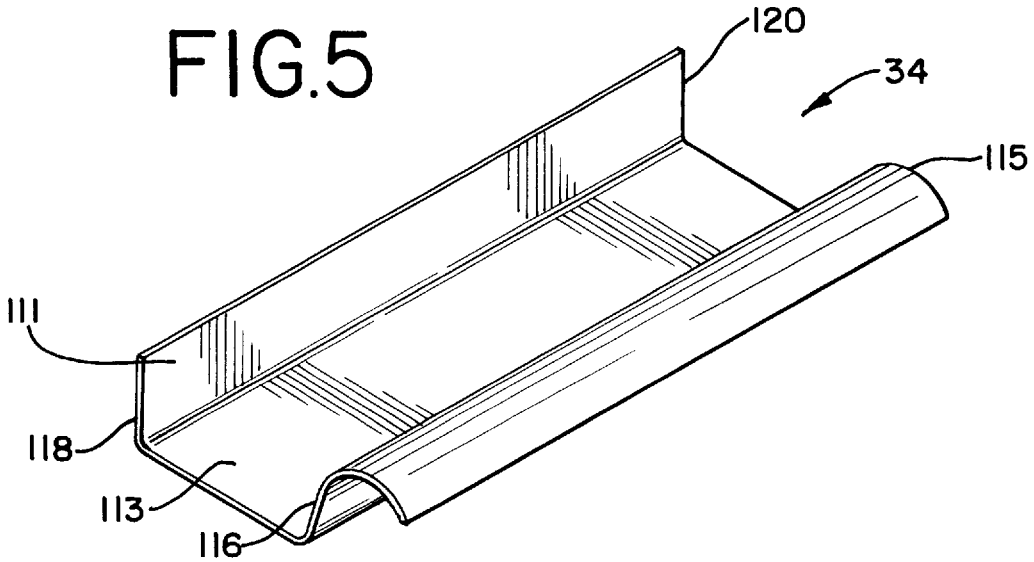
FIG. 5 is a perspective of a tray for positioning along the bottom edge of the storage apparatus.

FIG. 5 is a perspective view of the tray 34 illustrating a back upright wall 111, a flat planer wall positionable along inner edge 113, and front wall 115 which has a lower portion 116 providing an upward stance in relation to back panel 111 leading to a curvature which is positionable over a rod member. As previously mentioned, the side edges 118 and 120 are secured into their respective frame members which have a corresponding slot thereby providing a wall for the tray in four positions to prevent the loss of small items including marbles.

Figure 6:
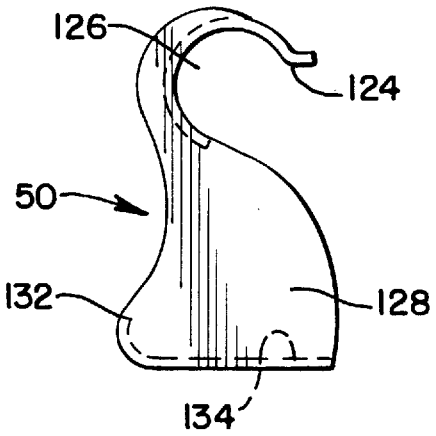
FIG. 6 is a side view of a bat holder for use in the storage apparatus.
Figure 6A:
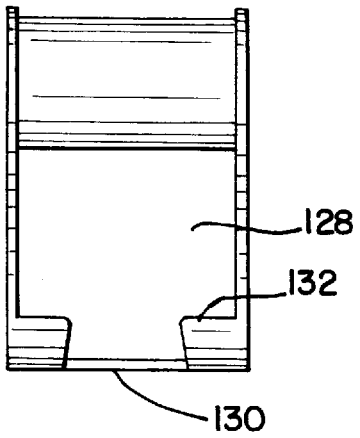
FIG. 6A is a front view of the bat holder of FIG. 6.

Now referring to FIGS. 6 and 6A, the bat holder 50 comprises a baseball bat hook with a lip 124 of such length so as to wrap around and form a chamber area 126 which provides an area for placement over a rod member. The base 128 of the baseball bat hook has a centrally disposed slot 130 sized to receive the neck of a baseball bat with upwardly facing tabs 132 allowing for the secure placement of the end of a baseball bat along surface 134. The tabs 132 prevent the baseball bat from sliding off the holder.

Figure 7:
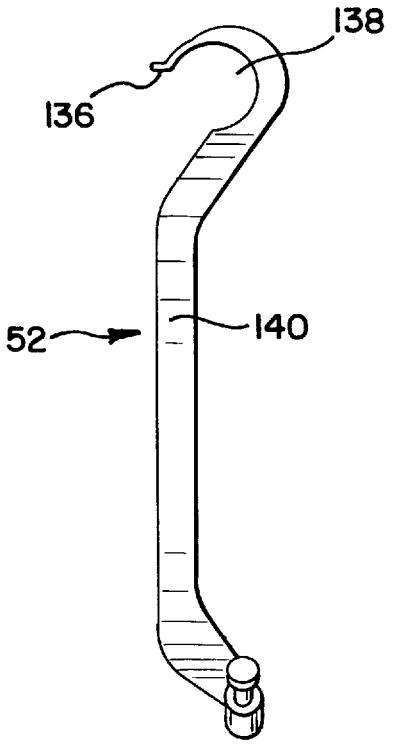
FIG. 7 is a side view of a skate holder for use in the storage apparatus.
Figure 7A:
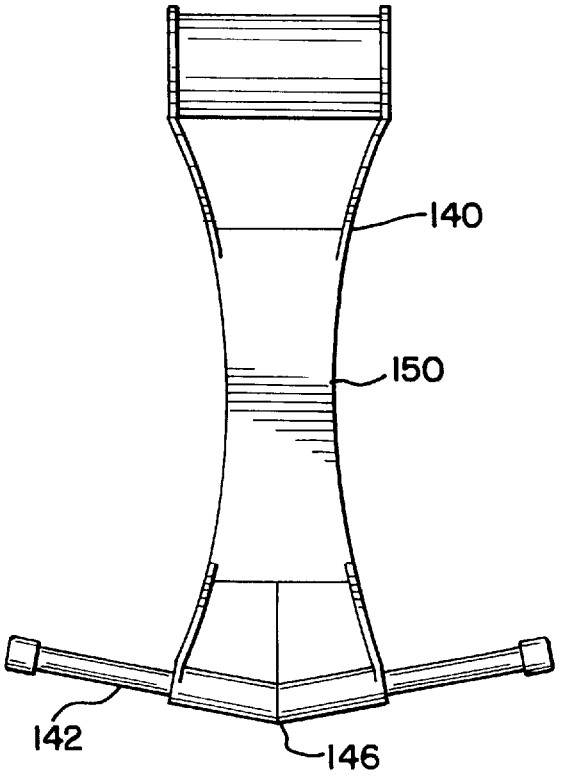
FIG. 7A is a front view of the skate holder of FIG. 7.

Now referring to FIGS. 7 and 7A, a skate support holder 52 comprising a skate support rack is depicted having lip 136 which wraps around to form chamber 138 which allows positioning over a rod member. The skate holder 52 includes body member 140 which is curved inwardly toward lip 136 providing a balancing of skates placed upon support posts 142. Support post 142 extend outwardly from a support base 146 of the skate support rack 52 and curvature 150 formed along body member 140 such that skates as depicted in FIG. 1 are hooked over support rod 142 with the base of the skate placed along curvature 150 allowing for the upright vertical stance of the in-line skates. The skate holder 52 is constructed of rigid plastic having a hook-shaped upper portion for engaging a horizontal rod member and a lower portion with opposing apertures each receiving a support post 142 extending outwardly and upwardly therefrom. The hook-shaped upper portion of the skate holder is placed over a rod member with each post available for securing a skate in an upright position.

It is to be understood that while we have illustrated and described certain forms of our invention, it is not to be limited to the specific forms or arrangement of parts herein described and shown. It will be apparent to those skilled in the art that various changes may be made without departing from the scope of the invention and the invention is not to be considered limited to what is shown in the drawings and described in the specification.

What is claimed is:

1. A storage apparatus for holding sports paraphernalia comprising:

first and second frame members having inner surfaces defining rod supports and back surfaces for attachment to a wall;

first and second rod members positioned in horizontal alignment with each other and extending between and secured to said rod supports located on said an inner surfaces of each said first and second frame members;

third and fourth rod members positioned in horizontal alignment with each other and extending between and secured to said rod supports located on said inner surfaces of each said first and second frame members;

a tray extending between and securing to a lower portion of said first and second frame members; and wherein said first and second rod members form an upper shelf for maintaining large sports items in a secure position away from the wall, said third and fourth rod members means form a middle shelf for maintaining other sports items in a secure position away from the wall, and said tray provides a lower shelf for maintaining further sports items in a secure position away from the wall; and said first and second frame members each include an enlarged rod support for allowing a rod member placed therein to be movable along a horizontal plane to accommodate various sized sporting goods.

2. The apparatus according to claim 1 wherein each said frame members are each further defined as a one piece molded plastic structure having an inner and an outer side wall defined by a top edge, a bottom edge, a front edge and a rear edge, said inner side wall having an upper support shelf bracket formed from a first fixed rod support disposed beneath said top edge adjacent said front edge and a second rod support disposed beneath said top edge adjacent said rear edge with said second rod support in the same horizontal plane as said first rod support, a middle support shelf bracket formed from a third fixed rod support disposed beneath said first fixed rod support adjacent said front edge and a fourth rod support disposed beneath said second rod support adjacent said rear edge with said fourth rod support in the same horizontal plane as said third rod support, a lower support shelf bracket formed from a fifth fixed rod support disposed beneath said third fixed rod support adjacent said front edge and above said lower edge with said lower edge providing a support surface along the length thereof.

3. The apparatus according to claim 1 wherein said outer side wall includes graphic sports indicia molded thereon.

4. The apparatus according to claim 1 including a fifth rod member positioned along a portion of said tray.

5. The apparatus according to claim 1 including a bat holder for securing a baseball bat to one of said rod members.

6. The apparatus according to claim 1 including a a skate holder for securing a pair of skates to one of said rod members.

7. The apparatus according to claim 1 wherein at least some of said rod members comprise metal tubing.

8. The apparatus according to claim 7 wherein said metal tubing is covered with plastic.

9. The apparatus according to claim 8 wherein said metal tubing comprises a steel tube and said plastic comprises a polyethylene plastic sleeve that conforms to said steel tube upon receipt of heat.

10. The apparatus according to claim 1 including at least one notch formed along a front edge of each of said first and second frame members, each said notch positioned along a corresponding horizontal plane for providing a holder to secure a hockey stick.

11. A storage apparatus for holding sports paraphernalia comprising:

first and second frame members having inner surfaces defining rod supports and back surfaces for attachment to a wall;

first and second rod members positioned in horizontal alignment with each other and extending between and secured to said rod supports located on said inner surfaces of said first and second frame members;

third and fourth rod members means positioned in horizontal alignment with each other and extending between and secured to said rod supports located on said inner surfaces of said first and second frame members;

a tray extending between and secured to a lower portion of said first and second frame members means; and wherein said first and second rod members form an upper shelf for maintaining large sports items in a secure position away from the wall, said third and fourth rod members means form a middle shelf for maintaining other sports items in a secure position away from the wall, and said tray means form provides a lower shelf for maintaining further sports items in a secure position away from the wall;

said frame members are each further defined as a one piece molded plastic structure having an inner and an outer side wall defined by a top edge, a bottom edge, a front edge and a rear edge, said inner side wall having an upper support shelf bracket formed from a first fixed rod support disposed beneath said top edge adjacent said front edge and a second rod support disposed beneath said top edge adjacent said rear edge with said second rod support in the same horizontal plane as said first rod support, a middle support shelf bracket formed from a third fixed rod support disposed beneath said first fixed rod support adjacent said front edge and a fourth rod support disposed beneath said second rod support adjacent said rear edge with said fourth rod support in the same horizontal plane as said third rod support, a lower support shelf bracket formed from a fifth fixed rod support disposed beneath said third fixed rod support adjacent said front edge and above said lower edge with said lower edge providing a support surface along the length thereof; and detents for locating rod members in a fixed position within the second and fourth rod supports.

12. A rack and tray apparatus for holding sports paraphernalia comprising:

first and second frame members each having an inner and an outer side wall defined by a top edge, a bottom edge, a front edge and a rear edge for attachment to a wall, said inner side wall having an upper support shelf bracket formed from a first fixed rod support disposed beneath said top edge adjacent said front edge and a second rod support defining an upper elongated slot disposed beneath said top edge adjacent said rear edge with said second rod support in the same horizontal plane as said first rod support, a middle support shelf bracket formed from a third fixed rod support disposed beneath said first fixed rod support adjacent said front edge and a fourth rod support defining a middle elongated slot disposed beneath said second rod support adjacent said rear edge with said fourth rod support in the same horizontal plane as said third rod support, a lower support shelf bracket formed from a fifth fixed rod support disposed beneath said third fixed rod support adjacent said front edge and above said lower edge with said lower edge providing a support surface along the length thereof, and said outer side wall having molded indicia placed thereon;

each frame member defining at least one notch formed along a front edge of each said frame member, each said notch positioned along a corresponding horizontal plane sized to secure a handle of a hockey stick;

a plurality of rod members extending between and securing to corresponding rod supports located on the same horizontal and parallel plane of said first and second frame members; and a tray juxtaposed to said bottom edge and extending between and secured to said first and second frame members.

13. A rack and tray apparatus for holding sports paraphernalia comprising:

first and second frame members each having an inner and an outer side wall defined by a top edge, a bottom edge, a front edge and a rear edge for attachment to a wall, said inner side wall having an upper support shelf bracket formed from a first fixed rod support disposed beneath said top edge adjacent said front edge and a second rod support defining an upper elongated slot disposed beneath said top edge adjacent said rear edge with said second rod support in the same horizontal plane as said first rod support, a middle support shelf bracket formed from a third fixed rod support disposed beneath said first fixed rod support adjacent said front edge and a fourth rod support defining a middle elongated slot disposed beneath said second rod support adjacent said rear edge with said fourth rod support in the same horizontal plane as said third rod support, a lower support shelf bracket formed from a fifth fixed rod support disposed beneath said third fixed rod support adjacent said front edge and above said lower edge with said lower edge providing a support surface along the length thereof, and said outer side wall having molded indicia placed thereon;

each frame member defining at least one notch formed along a front edge of each said frame member, each said notch positioned along a corresponding horizontal plane sized to secure a handle of a hockey stick;

a plurality of rod members extending between and secured to corresponding rod supports located on the same horizontal and parallel plane of said first and second frame members; and a tray juxtaposed to said bottom edge and extending between and secured to said first and second frame member; and said second and fourth rod supports are elongated wherein a rod member placed therein is movable along a horizontal plane providing an adjustment to each said support shelf bracket.

14. The apparatus according to claim 13 including a rod member positioned below and supporting said tray and extending horizontally between and secured to said fifth fixed rod support of each frame member.

15. The apparatus according to claim 13 including a baseball bat hook for securing a baseball bat to one of said rod members.

16. The apparatus according to claim 13 including a skate holder for securing a pair of skates to one of said rod members.

17. A rack and tray apparatus for holding sports paraphernalia comprising:

first and second frame members each having an inner and an outer side wall defined by a top edge, a bottom edge, a front edge and a rear edge for attachment to a wall, said inner side wall having an upper support shelf bracket formed from a first fixed rod support disposed beneath said top edge adjacent said front edge and a second rod support defining an upper elongated slot disposed beneath said top edge adjacent said rear edge with said second rod support in the same horizontal plane as said first rod support, a middle support shelf bracket formed from a third fixed rod support disposed beneath said first fixed rod support adjacent said front edge and a fourth rod support defining a middle elongated slot disposed beneath said second rod support adjacent said rear edge with said fourth rod support in the same horizontal plane as said third rod support, a lower support shelf bracket formed from a fifth fixed rod support disposed beneath said third fixed rod support adjacent said front edge and above said lower edge with said lower edge providing a support surface along the length thereof, and said outer side wall having molded indicia placed thereon;

each frame member defining at least one notch formed along a front edge of each said frame member, each said notch positioned along a corresponding horizontal plane sized to secure a handle of a hockey stick;

a plurality of rod members extending between and securing to corresponding rod supports located on the same horizontal and parallel plane of said first and second frame members; and a tray juxtaposed to said bottom edge and extending between and secured to said first and second frame member; and said second and fourth rod supports each include a means for locating a rod member in a fixed position along a portion of its slot.

18. The apparatus according to claim 17 wherein said means for locating a rod member in a fixed position comprises a plurality of detents positioned within said second and fourth rod supports.

* * * * *